US006733338B1

(12) United States Patent
Hsia

(10) Patent No.: US 6,733,338 B1
(45) Date of Patent: May 11, 2004

(54) HIGH CONDUCTIVITY CONNECTOR

(76) Inventor: Yu Chao Hsia, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/612,557

(22) Filed: Jul. 3, 2003

(51) Int. Cl.[7] ..... H01R 9/05
(52) U.S. Cl. ..... 439/578
(58) Field of Search ..... 439/578, 582, 439/583, 585

(56) References Cited

U.S. PATENT DOCUMENTS 3,223,954 A * 12/1965 Mateer ..... 336/175
4,358,174 A * 11/1982 Dreyer ..... 439/249
5,769,662 A * 6/1998 Stabile et al. ..... 439/578
6,146,196 A * 11/2000 Burger et al. ..... 439/578
6,491,546 B1 * 12/2002 Perry ..... 439/620

* cited by examiner

*Primary Examiner*—Tho D. Ta
*Assistant Examiner*—James R. Harvey

(57) ABSTRACT

A high conductivity connector has a first washer and a second washer installed in the outer post; the first washer is spaced to a second washer. In assembly, the first inner sleeve is inserted into the second inner sleeve; and then second inner sleeve is embedded into the hexagonal nut. Next, the hexagonal nut is engaged with outer post at one side of the outer post; the O ring is placed in an annular notch of the hexagonal nut. Then the first washer, guide pin, second washer and joint are installed into the outer post, wherein the guide pin resists against the second washer and a tip of the guide pin passes through the through hole of the second washer. Then, the connecting sleeve is installed at another end of the outer post so as to form the connector.

3 Claims, 4 Drawing Sheets

HIGH CONDUCTIVITY CONNECTOR

FIELD OF THE INVENTION

The present invention relates to connectors, and particularly to a high conductivity connector which has a preferred performance in heat conductivity, water-proof and stability.

BACKGROUND OF THE INVENTION

In the present invention, there are two ways for connecting a cable into connector. In one way, a cable is clamped between an inner tapered hole of a combing sleeve and the tapered head of a combining portion. The inner thread of the combining sleeve is engaged to the outer thread of the combining portion. Another end of the combining sleeve has outer threads which can engage to the inner thread of a connecting seat. In another connecting way, a stepped connecting sleeve is combined to a connecting portion. After a cable is inserted into a protruded end of the sleeve. Another iron sleeve with a larger diameter is fixed to the protruded end by pressing process. However, in above two ways, the combination is not stable and cables are easy to fall out. Moreover, water is possible to permeate into the connector so as to short the circuit. Thus, the performance of the prior art connectors is not so good to be accepted by users.

SUMMARY OF THE INVENTION

Accordingly, the primary object of the present invention is to provide a high conductivity connector, wherein a first washer and a second washer are installed in the outer post; the first washer is spaced to a second washer. In assembly, the first inner sleeve is inserted into the second inner sleeve; and then second inner sleeve is embedded into the hexagonal nut; next, the hexagonal nut is engaged with outer post at one side of the outer post; the O ring is placed in an annular notch of the hexagonal nut. Then the first washer, guide pin, second washer and joint are installed into the outer post, wherein the guide pin resists against the second washer and a tip of the guide pin passes through the through hole of the second washer. Then, the connecting sleeve is installed at another end of the outer post so as to form the connector.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figures 1, 1A:
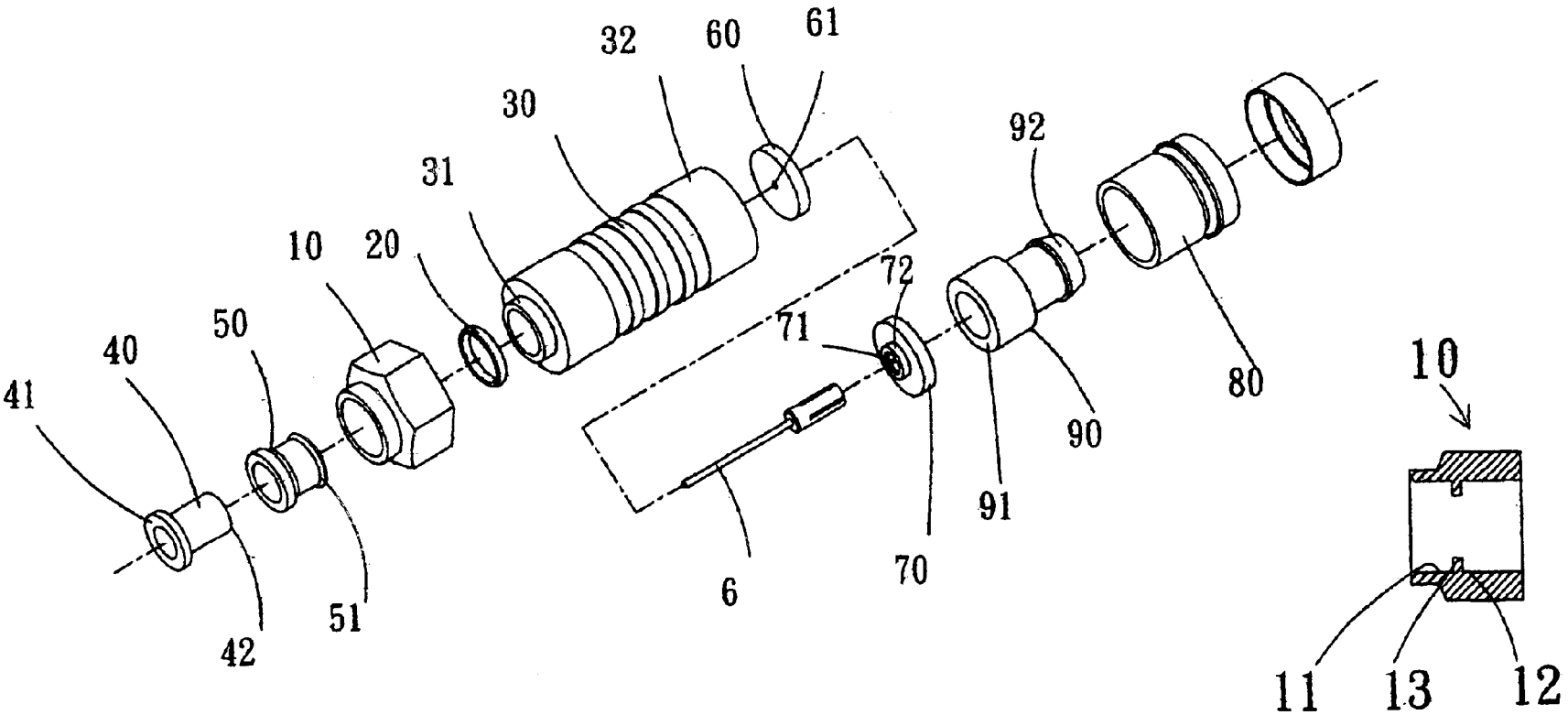
FIG. 1 is an exploded view of the present invention and FIG. 1A shows the cross section of the detail of one component in FIG. 1.

Referring to FIGS. 1 and 1A, the connector of the present invention is illustrated. The connector 1 includes a hexagonal nut 10, an O ring 20, an outer post 30, a first inner sleeve 40, a second inner sleeve 50, a first washer 60, a second washer 70, a connecting sleeve 80, a joint 90, etc.

A periphery of the hexagonal nut 10 is hexagonal and a center hole of the hexagonal nut 10 has a threaded section 11 at a front end of the hole, a annular notch 12 at another end of the hole and an annular flange 13 between the annular notch 11 and the annular notch 12.

The O ring 20 is embedded into the annular notch 12.

The outer post 30 is a hollow round cylinder. One end of the outer post 30 is protruded with a connecting end 31 for embedding into the annular notch 12 of the hexagonal nut 10. The O ring 20 serves to position the outer post 30 into the hexagonal nut 10. Another and of the outer post 30 is formed with a connection portion 32. The inner surface of the outer post 30 is divided into a straight section 33 and an expansion section 34.

One end of the first inner sleeve 40 is installed with a first stopper 41, and another end thereof is installed with a trumpet-like opening 42.

The second inner sleeve 50 has a structure similar to the first inner sleeve 40 and can be inserted into the hexagonal nut 10. The second inner sleeve 50 also has a second stopper 51. The first inner sleeve 40 is embedded into the second inner sleeve 50, the first stopper 41 of the first inner sleeve 40 resists against the second stopper 51 of the second inner sleeve 50.

The first washer 60 is made of Teflon and is installed at an inner side of a connecting ring 31 of the outer post 30. A through hole 61 is formed in a center of the first washer 60.

The second washer 70 is made of Teflon and is installed behind the first washer 60 with a space formed therebetween. A via hole 71 is formed in a center of the second washer 70. One side of the second washer 70 is formed with an embedding portion 72 for embedding with a guide pin 6. The guide pin 6 resists against the embedding portion 72 of the second washer 70 and a tip of the guide pin passes through the through hole 61 of the second washer 70.

The connecting sleeve 80 is a hollow round tube and is engagable to the connection portion 32 of the outer post 30.

One end of the joint 90 is formed with a thick ring 91 and another end thereof is installed with a tapered end 92. The thick ring 91 is embedded into the outer post 30. An end of the thick portion 91 resists against a surface of the second washer 70.

Figure 2:
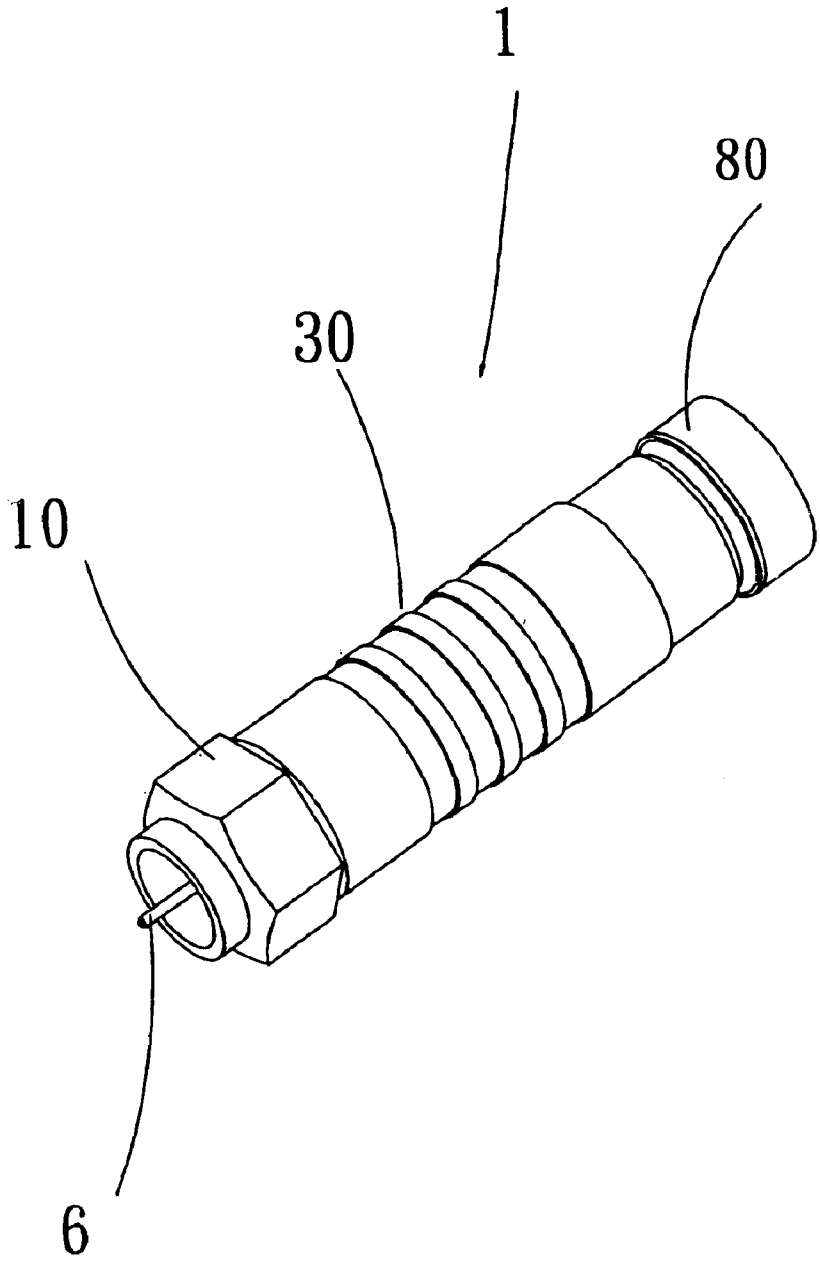
FIG. 2 is an assembled view of the present invention.
Figure 3:
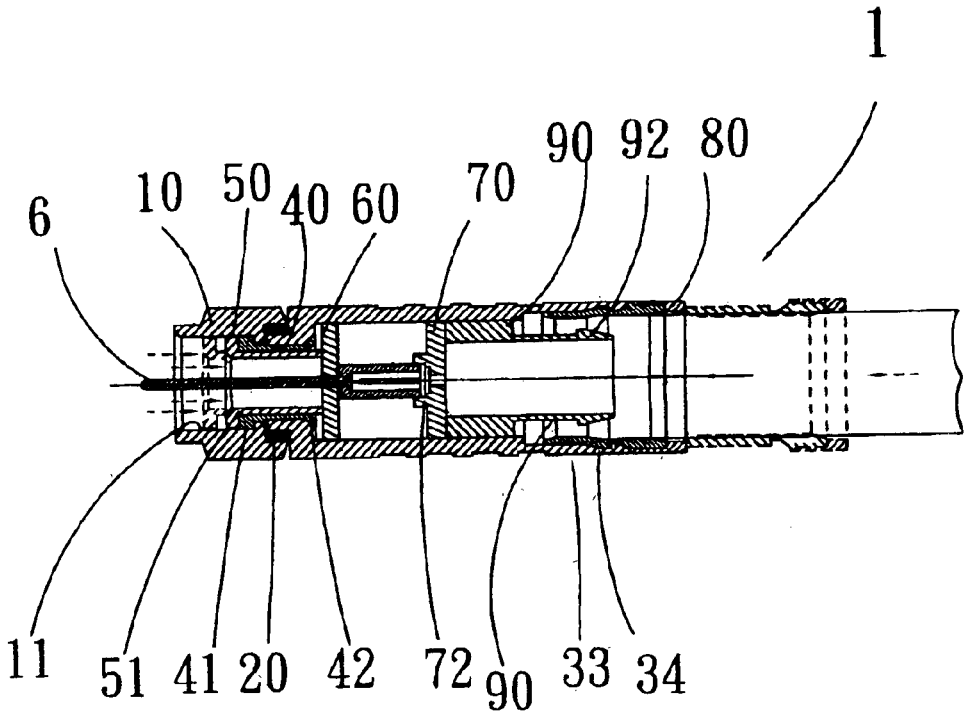
FIG. 3 is a cross sectional view of the present invention.
Figure 3:
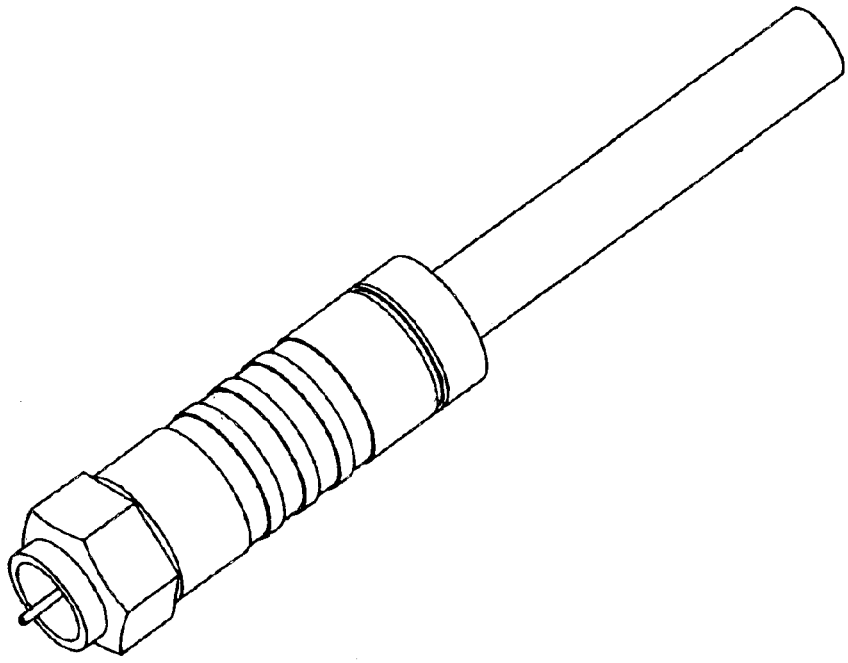

By above components, in assembly, the first inner sleeve 40 and second inner sleeve 50 are embedded into the hexagonal nut 10. Next, the hexagonal nut 10 is engaged with the connecting end 31 of the outer post 30. The O ring 20 is placed in the annular notch 12 of the hexagonal nut 10 so that hexagonal nut 10 is tightly engaged to the outer post 30. Then the first washer 60, guide pin 6, second washer 70 and joint 90 are installed into the outer post 30, wherein the guide pin 6 resists against the embedding portion 72 of the second washer 70 and a tip of the guide pin passes through the through hole 61 of the second washer 70. Then, the connecting sleeve 80 is installed at one end of the outer post 30 at the opposite side of the side connecting the hexagonal nut 10 so as to form the connector 1 of the present invention, as shown in FIGS. 2 and 3.

In use, two cables can be connected at two ends of the connector 1 of the present invention and then the two ends of the connector 1 are pressed for tightly connecting the cables to the connector 1.

Figure 4:
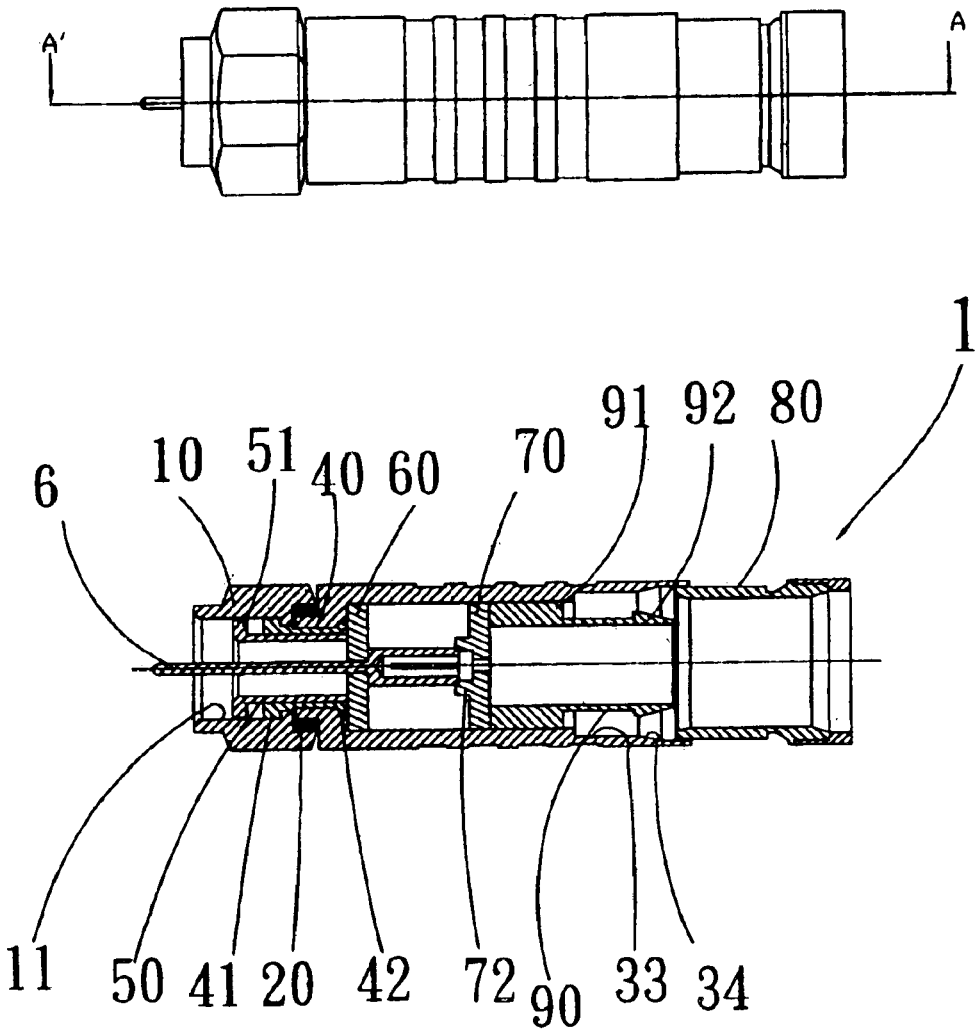
FIG. 4 is a schematic view showing the embodiment of the present invention.

In above pressing process, as shown in FIG. 4, the hexagonal nut 10, O ring 20, outer post 30, first inner sleeve 40, second inner sleeve 50, first washer 60, second washer 70, connecting sleeve 80 and joint 90 are formed with the connector 1 of the present invention so then cables are connected to the two ends of the connector 1. Then a pair of pliers are used to press the two ends of the connector 1.

In the present invention, the first washer 60 and second washer 70 are made of Teflon. Since Teflon has the effects of heat-tolerance, wear-tolerance and good electric conduction, the connector 1 of the present invention has preferred electric property. The pressing process can increase the stability of the connector. The trumpet opening at one end of the first inner sleeve 40 of the hexagonal nut 10 can avoid the deformation and twisting of the connector 1 in pressing process.

The present invention is thus described, it will be obvious that the same may be varied In many ways. Such variations are not to be regarded as a departure from the spirit and scope of the present invention, and all such modifications as would be obvious to one skilled in the art are intended to be included within the scope of the following claims.

What is claimed is:

1. A high conductivity connector comprising a hexagonal nut, an O ring, an outer post, a first inner sleeve, a second inner sleeve, a first washer, a second washer, a connecting sleeve, a joint, and a guide pin; characterized in that:

the first inner sleeve is a hollow tube, one end of the first inner sleeve has a stopper and another end thereof is a trumpet opening; a first washer and a second washer are installed in the outer post; the first washer is spaced to a second washer;

in assembly, the first inner sleeve is inserted into the second inner sleeve; and then second inner sleeve is embedded into the hexagonal nut; next, the hexagonal nut is engaged with the outer post at one side of the outer post; the O ring is placed in an annular notch of the hexagonal nut so that hexagonal nut is tightly engaged to the outer post; then the first washer, the guide pin, the second washer and the joint are installed into the outer post, wherein the guide pin resists against the second washer and a tip of the guide pin passes through the through hole of the second washer; and the first washer is placed near the hexagonal nut; then, the connecting sleeve is installed at another end of the outer post so as to form the connector.

2. The high conductivity connector as claimed in claim 1, wherein a through hole is formed in a center of the first washer; a via hole is formed in a center of the second washer and one side of the second washer is formed with an embedding portion for embedding with a guide pin; the guide pin resists against the embedding portion of the second washer and a tip of the guide pin passes through the through hole of the second washer.

3. The high conductivity connector as claimed in claim 1, wherein the first washer and second washer are made of Teflon.

* * * * *